US008914219B2

(12) United States Patent
Neubauer et al.

(10) Patent No.: US 8,914,219 B2
(45) Date of Patent: Dec. 16, 2014

(54) METHOD FOR OPERATING AN INTERNAL COMBUSTION ENGINE

(75) Inventors: Andreas Neubauer, Ludwigsburg (DE); Jörg Präger, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 896 days.

(21) Appl. No.: 12/829,430

(22) Filed: Jul. 2, 2010

(65) Prior Publication Data

US 2011/0004395 A1 Jan. 6, 2011

(30) Foreign Application Priority Data

Jul. 4, 2009 (DE) ..... 10 2009 031 707

(51) Int. Cl.

| | |
|---|---|
| ***F02D 41/30*** | (2006.01) |
| ***F02D 41/16*** | (2006.01) |
| ***F02D 41/14*** | (2006.01) |
| ***F02D 41/24*** | (2006.01) |

(52) U.S. Cl.

CPC ..... *F02D 41/16* (2013.01); *F02D 41/1401* (2013.01); *F02D 41/1497* (2013.01); *F02D 41/2451* (2013.01); *F02D 41/2467* (2013.01); *F02D 2200/1012* (2013.01); *F02D 2400/04* (2013.01); *F02D 2400/06* (2013.01)

USPC ..... 701/104; 123/436

(58) Field of Classification Search

CPC . F02D 41/16; F02D 41/1401; F02D 41/1497; F02D 41/2451; F02D 41/2467; F02D 2400/04; F02D 2400/06; F02D 2200/1012

USPC ..... 123/339.12, 339.19, 339.21, 406.45, 123/406.47, 478, 480, 486, 494, 674, 675, 123/679, 680, 687; 701/103, 104, 106, 110; 702/182

See application file for complete search history.

(56) References Cited

U.S. PATENT DOCUMENTS

| | | | | |
|---|---|---|---|---|
| 5,060,618 | A * | 10/1991 | Takaoka et al. | 123/436 |
| 5,506,778 | A * | 4/1996 | Matsumoto et al. | 701/111 |
| 6,640,777 | B2 * | 11/2003 | Enoyoshi et al. | 123/406.24 |
| 7,493,889 | B2 | 2/2009 | Nickel et al. | |
| 7,637,248 | B2 * | 12/2009 | Naegele et al. | 123/406.37 |
| 8,074,623 | B2 * | 12/2011 | Carlsson et al. | 123/436 |
| 8,333,174 | B2 * | 12/2012 | Carlsson et al. | 123/339.1 |

FOREIGN PATENT DOCUMENTS

| | | | |
|---|---|---|---|
| JP | H08-200140 | A | 8/1996 |
| JP | 2002-276428 | A | 9/2002 |
| JP | 2004-346819 | A | 12/2004 |
| JP | 2008-045545 | A | 2/2008 |

* cited by examiner

*Primary Examiner* — Thomas Moulis
*Assistant Examiner* — Elizabeth Hadley
(74) *Attorney, Agent, or Firm* — Gudrun E. Huckett

(57) ABSTRACT

In a method for operating an internal combustion engine for adjusting a desired fuel/air mixture, wherein the rotary speed is determined by an operating curve based on a fuel/air mixture composition, wherein the operating curve has ascending and descending branches and a maximum, wherein a lambda value is smaller than 1 on the descending branch, it is first determined by statistic evaluation whether the operating point is on the ascending or descending branch. In a second method step, when the operating point is not on a desired branch of the operating curve desired as a starting point for a third method step, at least one operating parameter is changed until the operating point is positioned on the desired branch. In a third method step, the maximum of the operating curve is determined. Based on the determined maximum, the desired operating point of the internal combustion engine is then adjusted.

25 Claims, 3 Drawing Sheets

METHOD FOR OPERATING AN INTERNAL COMBUSTION ENGINE

BACKGROUND OF THE INVENTION

The invention relates to a method for operating an internal combustion engine.

In internal combustion engines, the fuel quantity that is being supplied to the internal combustion engine must be adjusted. When the environmental conditions change or the filled-in fuel type has changed the supplied fuel quantity must be adjusted accordingly. The correlation between the engine speed that is generated and the supplied fuel quantity is defined by an operating curve for otherwise unchanged operating conditions; such an operating curve has an ascending branch, a maximum, and a descending branch. The ascending branch characterizes the lean range of the mixture and the descending branch indicates the rich range of the mixture.

For adjusting the fuel quantity that is to be supplied it is known to determine on which branch of the operating curve the operating point of the internal combustion engine is located and, based thereon, to adjust the desired operating point. This is realized usually in that the supplied fuel quantity is reduced and the engine speed response of the engine is evaluated. When the operating point is located on the ascending branch of the operating curve, the engine speed will drop. When the operating point is located on the descending branch of the operating curve, the engine speed will increase when the mixture becomes lean. In particular at idle of the internal combustion engine, a further leaning of the mixture when the mixture is already very lean can cause the internal combustion engine to stall.

SUMMARY OF THE INVENTION

It is an object of the present invention to provide a method for operating an internal combustion engine with which the fuel quantity to be supplied can be reliably adjusted.

In accordance with the present invention, this is achieved by a method for operating an internal combustion engine with a combustion chamber, a piston delimiting the combustion chamber and driving in rotation a crankshaft, with a device for supplying fuel, a device for supplying combustion air, and a device for detecting the rotary speed of the crankshaft, wherein the rotary speed as a function of the composition of the fuel/air mixture is adjusted in accordance with an operating curve that has an ascending branch, a maximum, and a descending branch, wherein the lambda value in the combustion chamber of the internal combustion engine in the area of the descending branch is smaller than 1, wherein for adjusting a desired fuel/air mixture composition:

in a first method step, by a statistic evaluation it is determined whether the operating point of the internal combustion engine is on the ascending branch or the descending branch;

in a second method step, when the operating point is not on a branch of the operating curve that is desired as a starting point for a third method step, at least one operating parameter is changed until the operating point is on the desired branch of the operating curve;

in a third method step, the position of the maximum of the operating curve is determined; and in a fourth method step based on the determined maximum a desired operating point of the internal combustion engine is adjusted.

Since, initially, in a coarse test by means of statistic evaluation it is determined on which branch of the operating curve the operating point of the internal combustion engine is located, it can be avoided that the operating point is adjusted in a range in which the internal combustion engine may stall, for example, in that the mixture is impermissibly made leaner. Subsequently, a defined starting point for a fine test for determining the position of the maximum of the operating curve is adjusted or set. The defined operating point is defined by its position on the ascending branch or the descending branch of the operating curve. The precise position of the operating point must not be known. Based on this defined starting point on one of the two branches of the operating curve, the position of the maximum of the operating curve is determined and starting at the maximum a desired operating point is adjusted. Since for determining on which branch the operating point is positioned, no action affecting the engine is performed and no changes are made to the supplied fuel quantity or other operating parameters of the internal combustion engine, for example, the ignition timing, it is ensured that the operating point is not initially impermissibly adjusted such that the engine might stall. The statistic evaluation is done initially such that the running behavior of the internal combustion engine is not affected. Only when it has been determined on which branch the operating point is located, an operating parameter, for example, the supplied fuel quantity, is changed for adjusting a starting point on a desired branch of the operating curve and for determining the position of the maximum of the operating curve. Instead of changing the supplied fuel quantity, also other operating parameters of the internal combustion engine, for example, the ignition timing, may be changed.

Advantageously, the method is performed during idle of the internal combustion engine. In particular, at idle the internal combustion engine reacts quickly by stalling in case of impermissible leaning of the fuel/air mixture. The use of the proposed method according to the invention is particularly advantageous in this situation.

Advantageously, the statistic evaluation in the first method step is based on the ratio of the engine cycles in which combustion takes place to the engine cycles in which no combustion takes place. It has been found that, when the internal combustion engine idles, the number of engine cycles in which combustion takes place and the number of engine cycles in which no combustion takes place differ greatly depending on whether the operating point of the internal combustion engine is on the ascending branch, i.e., the mixture is thus lean, or the operating point is on the descending branch, i.e., the mixture is rich. When the combustion engine is operated with a lean fuel/air mixture, there are often comparatively weak combustions in sequential engine cycles. Since the combustions are relatively weak, already after a few engine cycles again a combustion or several sequential combustions may occur. When the internal combustion engine operates with a rich fuel/air mixture, the combustions are excellent. The combustion chamber must be scavenged for several revolutions of the crankshaft until a sufficiently combustible mixture is present again in the combustion chamber. When the internal combustion engine is operated with a rich mixture, an engine cycle with combustion is followed usually by a larger number of engine cycles without combustion. The number of engine cycles in which combustion takes place relative to the number of engine cycles in which no combustion takes place is therefore significantly greater when the operating point of the internal combustion engine is on the ascending branch.

It can also be provided that the statistic evaluation in the first method step is realized based on an engine speed change for engine cycles in which a combustion takes place. Since the combustion is very good when the internal combustion engine is operated with a rich mixture, the engine speed change is also very large while during lean operation only a minimal engine speed change during an engine cycle occurs. However, it can also be advantageous that the statistic evaluation in the first method step is realized based on the number of sequential engine cycles in which combustion takes place or in which no combustion takes place. In lean operation combustions usually happen in several sequential engine cycles. The number of sequential engine cycles in which no combustion takes place is however significantly greater in rich operation than in lean operation.

The statistic evaluation in the first method step can however also be realized based on the observed pattern of the engine cycles in which combustion takes place and of the engine cycles in which no combustion takes place. As a result of the respective characteristic pattern of combustions characteristic vibrations occur also. It can also be provided that the statistic evaluation in the first method step is based on the vibrations that are generated by the internal combustion engine. Advantageously the statistic evaluation is realized for a predetermined number of revolutions of the crankshaft. For example, approximately 50 revolutions up to several hundred revolutions of the crankshaft can be evaluated. Since a predetermined number of revolutions of the crankshaft are statistically evaluated, the position of the operating point can be determined with high reliability.

The operating parameter is advantageously the supplied fuel quantity. Advantageously, the supplied fuel quantity is increased in the second method step when in the first method step it is determined that the operating point is not on the descending branch of the operating curve. In this way, an impermissible leaning of the mixture can be reliably prevented.

Advantageously, in the second method step the operating parameter, for example, the supplied fuel quantity, is changed in a stepwise fashion and, for each change of the operating parameter, it is checked based on the statistic evaluation whether the operating point is on the desired branch. In this way, an adjustment of the operating point on the desired branch is realized in a simple way.

For determining the maximum in the third method step it is provided that the operating parameter is changed stepwise in the direction toward the maximum of the operating curve and the resulting rotary speed change is determined. As soon as the rotary speed no longer increases, the operating point of the internal combustion engine is at the maximum of the operating curve. The stepwise change of the operating parameter in the second method step is realized advantageously in steps that are multiple times greater than the steps used in the third method step. In the second method step only a coarse adjustment is performed while in the third method step a fine adjustment is performed. It is provided that the desired operating point is adjusted in the fourth method step by changing the supplied fuel quantity.

Advantageously, the statistic evaluation at idling of the internal combustion engine is repeated regularly. In this way, it can be ensured that the operating point of the internal combustion engine is positioned on the descending branch. When the operating point is not on this branch it is provided that the second, the third, and the fourth method steps are performed again and in this way the operating point is adjusted.

Advantageously, the internal combustion engine is a two-stroke engine and the fuel passes through transfer passages together with the combustion air into the combustion chamber. The fuel is introduced in particular into an intake passage of the internal combustion engine or directly into a crankcase of the internal combustion engine. In case of such an introduction of the fuel a delay between the change of the supplied fuel quantity and the engine speed response of the internal combustion engine exists. It takes several engine cycles until the changed fuel quantity reaches the combustion chamber. In case of internal combustion engines that, as a result of their construction, have a delay in the engine speed response, an excessive leaning of the fuel/air mixture happened easily in prior art engines. Therefore, the proposed method according to the invention is advantageous in particular for these types of internal combustion engines.

Embodiments of the invention will be explained in the following with aid of the drawings.

DESCRIPTION OF THE PREFERRED EMBODIMENTS

Figure 1:
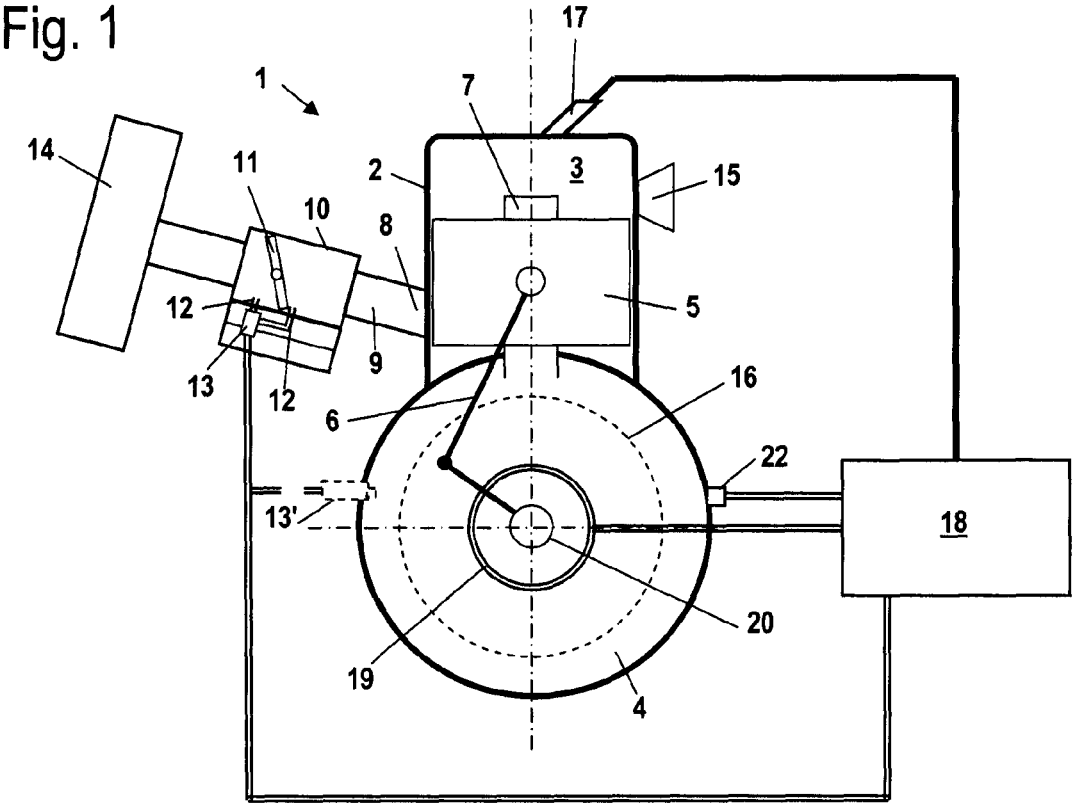
FIG. 1 is a schematic illustration of an internal combustion engine.

The internal combustion engine 1 illustrated in FIG. 1 is a single-cylinder two-stroke engine and serves advantageously for operating the tool member of a hand-held power tool such as a motor chainsaw, a trimmer, a cut-off machine, a lawnmower or the like. The internal combustion engine 1 comprises a cylinder 2 in which a combustion chamber 3 is formed. The combustion chamber 3 is delimited by a piston 5 that is reciprocatingly supported in a cylinder 2 and drives by means of a connecting rod 6 a crankshaft 20 that is rotatably supported in crankcase 4. For supply of combustion air the internal combustion engine 1 comprises an intake passage 9 that is connected to the air filter 14. In the intake passage 9 a carburetor 10 may be arranged in which a throttle element, for example, a throttle valve 11, is pivotably supported. Fuel openings 12 open into the intake passage 9 within carburetor 10. The fuel quantity that is supplied to the fuel openings 12 is controlled by a metering valve 13. The metering valve 13 is controlled by an electronic control unit 18.

The intake passage 9 opens into the crankcase 4 with an inlet 8 that is piston-controlled by the piston 5. In the area of the bottom dead center of the piston 5 the interior of the crankcase 4 is connected by flow passages 7 to the combustion chamber 3. By means of the flow passages 7, of which in FIG. 1 only one is illustrated, the fuel/air mixture flows out of the crankcase 4 into the combustion chamber 3. In the area of the top dead center of the piston 5, the fuel/air mixture is ignited by a spark plug 17 projecting into the combustion chamber 3 and exits the combustion chamber 3 through the outlet 15. The spark plug 17 is also connected to the electronic control unit 18 and is controlled by it and supplied with energy. For energy supply a generator 19 is arranged on the crankshaft 20. Based on the signal of the generator 19 the electronic control unit 18 derives the rotary speed n of the crankshaft 20. On the crankshaft 20 there is also a fan wheel 16 arranged for supplying the internal combustion engine 1 with cooling air. On the crankcase 4 a vibration sensor 22 is arranged that is also connected to the electronic control unit 18.

Instead of supplying the fuel through carburetor 10, the fuel can also be supplied directly into the crankcase 4. For this purpose, the metering valve 13' that is schematically indicated in FIG. 1 is provided.

Figure 2:
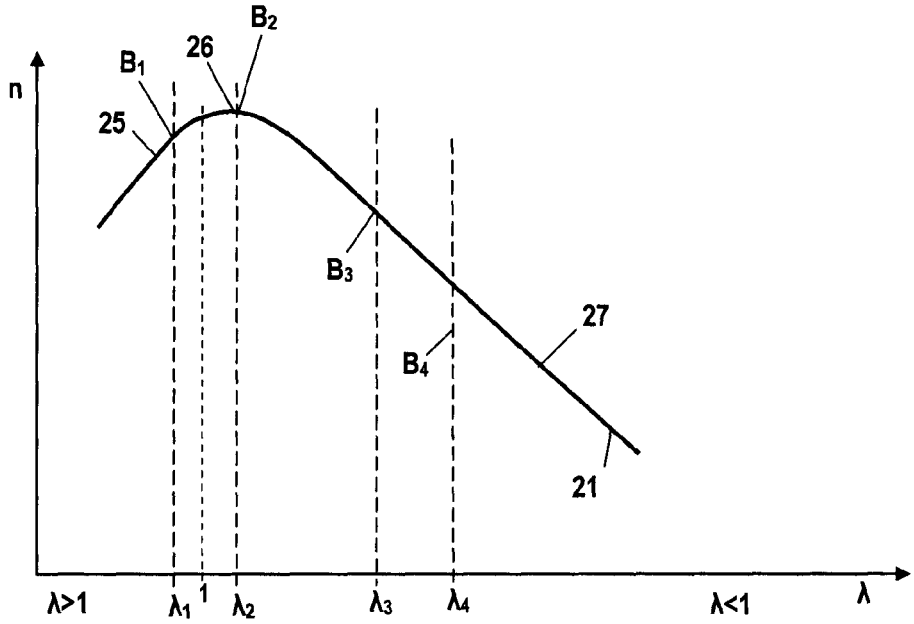
FIG. 2 is a diagram that indicates schematically the course of the engine speed plotted against the lambda value λ.

The rotary speed n of the crankshaft 20 in operation with otherwise constant operating conditions is adjusted as a function of the lambda value λ according to the operating curve 21 illustrated in FIG. 2. The operating curve 21 has an ascending branch 25 that encompasses the range in which the lambda value is greater than 1, i.e., the fuel/air mixture is lean. The operating curve 21 has a maximum 26 that may be, for example, located at a lambda value of somewhat greater than 1. Moreover, the operating curve 21 has a descending branch 27 in the range in which the lambda value λ is smaller than 1, i.e., the fuel/air mixture is rich. In FIG. 2, schematically four operating points $B_1$, $B_2$, $B_3$, $B_4$ with correlated lambda values $\lambda_1$, $\lambda_2$, $\lambda_3$, $\lambda_4$ are illustrated. The operating point $B_1$ is positioned on the ascending branch 25, the operating point $B_2$ is positioned at maximum 26, and the operating points $B_3$, B4 are positioned on the descending branch 27. The operating point $B_4$ corresponds in this embodiment to the desired operating point.

Figure 3:
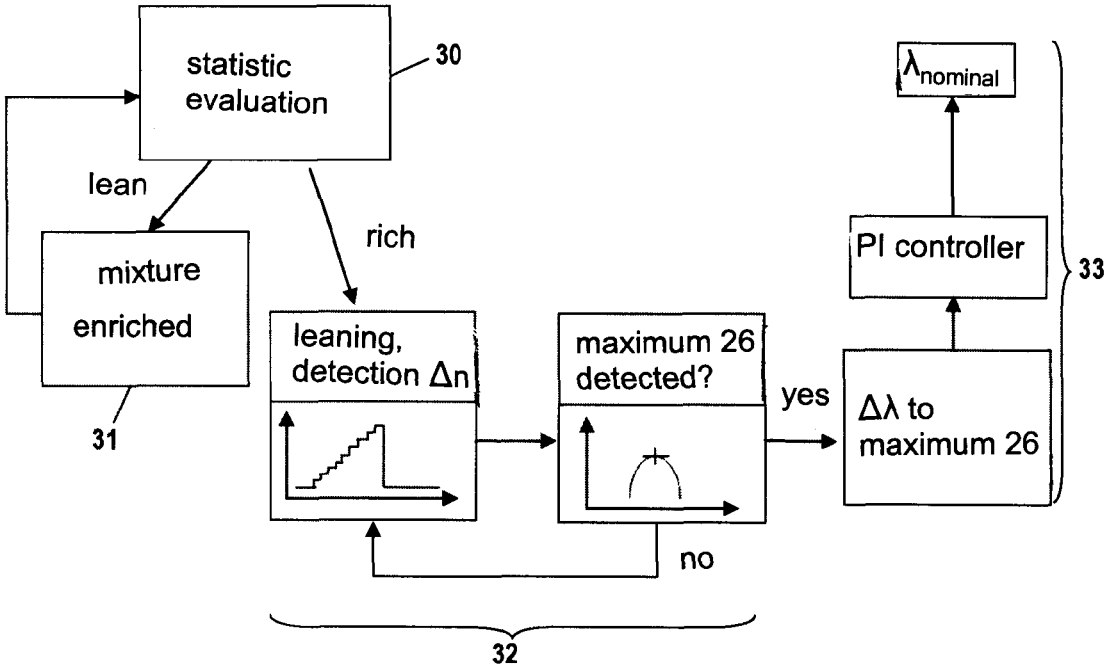
FIG. 3 shows a flow chart of the method steps of the proposed method.
Figure 4:
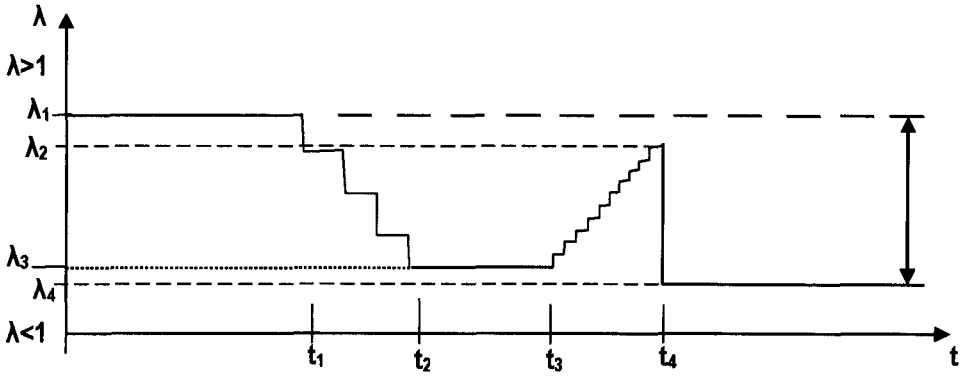
FIG. 4 shows the course of the lambda value λ over time when performing the method according to the invention.

For adjusting the desired operating point $B_4$ the method that is schematically indicated in FIGS. 3 and 4 is performed. In the first method step 30 based on a statistic evaluation it is determined whether the operating point of the internal combustion engine 1 is on a desired branch of the operating curve 21. This is advantageously the descending branch 27. When by means of statistic evaluation in the first method step 30 it is determined that the operating point is on the ascending branch 25, for example, at the operating point $B_1$, i.e., the mixture is lean, in the second method step 31 an increase of the supplied fuel quantity is carried out. The mixture is enriched. This is done according to FIG. 4 at the point in time $t_1$. The mixture enrichment is realized advantageously step by step. In FIG. 4, this is illustrated in an exemplary fashion based on operating point $B_1$ with lambda value $\lambda_1$. After a step-wise increase of the supplied fuel quantity the first method step 30 is repeated and it is checked again by statistic evaluation whether the operating point is now on the descending branch 27. If this is not the case, the supplied fuel quantity is increased again. In FIG. 4, an increase of the supplied fuel quantity takes place four times until the operating point of the internal combustion engine 1 is at operating point $B_3$. Since the increased quantity of supplied fuel must first pass through the intake passage into the crankcase 4 and then through the transfer passages 7 into the combustion chamber until a change of behavior of the internal combustion engine 1 results, the operating point $B_3$ will already be located at a significant spacing away from the maximum 26 before by means of statistic evaluation in the first method step 30 it is determined that the operating point on the descending branch 27.

When in the first method step 30 it is determined that the operating point is already on the descending branch 27, i.e., the operating point is, for example, the operating point $B_3$ in FIG. 2, in the second method step 31 no change of the supplied fuel quantity takes place. This is indicated in FIG. 4 by dotted line for the lambda value $\lambda_3$.

At the point in time $t_2$ in FIG. 4 by means of statistic evaluation in the first method step 30 it is determined that the operating point $B_3$ is positioned on the descending branch 27. Subsequently, at the point $t_3$ the supplied fuel quantity is reduced in a stepwise fashion and the resulting change in the rotary speed n is detected. The reduction of the supplied fuel quantity, i.e., leaning of the mixture, is also done in a stepwise fashion. As shown in FIG. 4, the steps with which the supplied fuel quantity in the third method step 32 is reduced is significantly smaller than the steps with which the fuel increase is done in the second method step 31. In this way, the position of the maximum 26, despite the slow reaction of the internal combustion engine 1 to the change of the supplied fuel quantity, can be determined with satisfactory precision. The fuel quantity is reduced more and more until the maximum 26 of the operating curve 21 is detected. The maximum 26 is present when for a reduction of the supplied fuel quantity no further rotary speed increase but only a steady rotary speed or a dropping rotary speed is detected. Based on the recognized position of the maximum 26 of the operating curve 21 in the fourth method step 33 a desired lambda value $\lambda_{nominal}$—in the embodiment the lambda value $\lambda_4$—is adjusted. This can be done, for example, by PI controller (proportional plus integral controller) with an appropriate change of the supplied fuel quantity.

Figure 5:
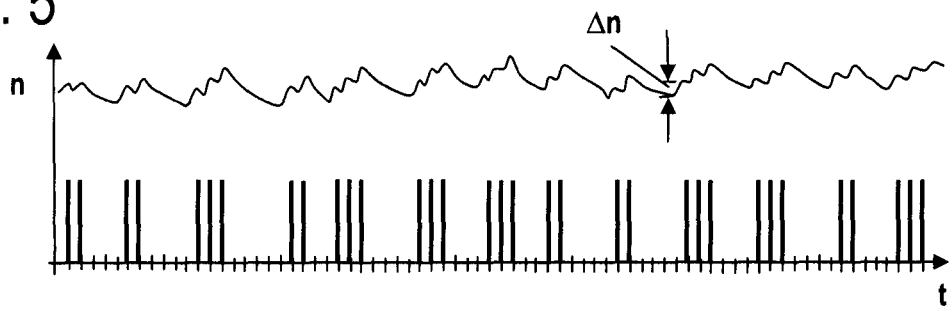
FIG. 5 is a diagram that indicates schematically the course of the engine speed and the engine cycles in which a combustion takes place for an operating point of the internal combustion engine on the ascending branch.

The statistic evaluation in the first method step 30 can be done in various ways based on the generated characteristic pattern of the engine cycles with combustion, of engine cycles without combustion, and the resulting characteristic rotary speed course. In FIG. 5, the course of the rotary speed n over time t is schematically illustrated for the combustion pattern that is indicated in FIG. 5 by bars. An engine cycle with combustion is characterized by a vertical bar. As shown in FIG. 5, for each combustion an increase of the rotary speed by a rotary speed change Δn results. Usually combustions occur in to directly sequentially occurring engine cycles. Between groups of sequential engine cycles with combustion there are usually some engine cycles without combustion. The pattern illustrated in FIG. 5 and the illustrated course of the rotary speed n are found in an internal combustion engine 1 whose operating point is on the ascending branch 25, i.e., that is supplied with a lean mixture.

Figure 6:
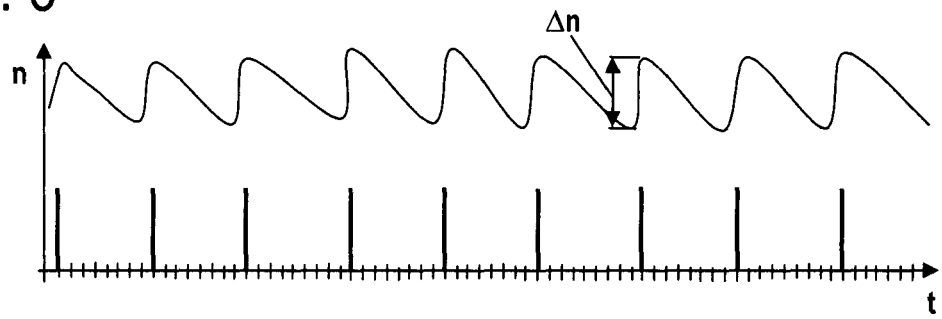
FIG. 6 is a diagram that schematically indicates the course of the engine speed and the engine cycles in which a combustion takes place over time for an operating point of the internal combustion engine on the descending branch.

FIG. 6 shows the course of the rotary speed n and the engine cycles with and the engine cycles without combustion for an internal combustion engine 1 whose operating point is on the descending branch 27, i.e., a rich fuel/air mixture is supplied to the engine. In this situation, a single engine cycle with combustion occurs that is followed by a comparatively large number of engine cycles without combustion. For example, every six to ten engine cycles a combustion will occur. As indicated by the rotary speed course, the rotary speed increase for an engine cycle with combustion, i.e., the resulting rotary speed change Δn is significantly greater than for the engine speed course illustrated in FIG. 5.

For determining whether the operating point of the internal combustion engine 1 is on the ascending branch 25 or the descending branch 27, the resulting rotary speed course and the resulting engine cycles with or without combustion can be evaluated in different ways.

The number of engine cycles in which a combustion occurs relative to the number of engine cycles in which no combustion occurs can be evaluated. This ratio for an operating point that is on the ascending branch 25 is significantly greater than for an operating point on the descending branch 27. Also, the engine speed change Δn for an engine cycles in which combustion occurs can be statistically evaluated. Moreover, the number of sequential engine cycles in which combustion occurs, or the number of sequential engine cycles in which no combustion occurs can be evaluated. As illustrated in FIGS. 5 and 6, the number of sequential engine cycles in which combustion occurs is between two and three while at an operating point on the descending branch 27 only a single engine cycle with combustion occurs, respectively. The number of sequential engine cycles in which no combustion occurs is significantly smaller in the diagram according to FIG. 5 than in the diagram according to FIG. 6.

It can also be provided to evaluate the different patterns of engine cycles with combustion and engine cycles without combustion. Also, it can be provided that the signal of the vibration sensor 22 is used in order to carry out the statistic evaluation of the generated vibrations. As a result of the different patterns of engine cycles with and engine cycles without combustion different vibrations occur depending on whether the operating point is on the ascending branch 25 or on the descending branch 27. The statistic evaluation is advantageously realized for a predetermined number of crankshaft revolutions, for example for approximately 100 revolutions of the crankshaft. However, also a different number of crankshaft revolutions can be used for statistic evaluation. Advantageously, 50 revolutions up to a few 100 revolutions of the crankshaft 20 are utilized for statistic evaluation.

In the illustrated embodiment, as an operating parameter the supplied fuel quantity is changed. Instead, also other operating parameters, for example, the ignition timing can be changed. Also, a change of several operating parameters may be advantageous.

The specification incorporates by reference the entire disclosure of German priority document 10 2009 031 707.4 having a filing date of Jul. 4, 2009.

While specific embodiments of the invention have been shown and described in detail to illustrate the inventive principles, it will be understood that the invention may be embodied otherwise without departing from such principles.

What is claimed is:

1. A method for operating an internal combustion engine, wherein the internal combustion engine comprises a combustion chamber, a piston that delimits the combustion chamber and drives in rotation a crankshaft, a device for supplying fuel, a device for supplying combustion air, and a device for detecting a rotary speed of the crankshaft, wherein the rotary speed is determined in accordance with an operating curve based on a composition of a fuel/air mixture, wherein operating points of the internal combustion engine are lying on the operating curve and the operating curve has an ascending branch, a maximum, and a descending branch, wherein a lambda value in the combustion chamber of the internal combustion engine is smaller than 1 in the range of the descending branch, wherein, for adjusting a desired fuel/air mixture composition, the method comprises:

in a first method step, determining by a statistic evaluation whether an operating point of the internal combustion engine is on the ascending branch or the descending branch;

in a second method step, when the operating point is not positioned on a desired branch of the operating curve that is desired as a starting point for a third method step, changing at least one operating parameter until the operating point is positioned on the desired branch of the operating curve by adjusting the at least one operating parameter in adjusting steps and, after a change of the at least one operating parameter, checking based on the statistic evaluation whether the operating point is on the desired branch;

in a third method step, determining a position of the maximum of the operating curve by adjusting the at least one operating parameter in adjusting steps in a direction toward the maximum of the operating curve and determining a resulting rotary speed change, wherein in the second method step the adjusting steps for adjusting the at least one operating parameter are multiple times greater than the adjusting steps for adjusting the at least one operating parameter in the third method step; and in a fourth method step, based on the determined maximum of the operating curve, adjusting the desired operating point of the internal combustion engine.

2. The method according to claim 1, wherein the method is performed when the internal combustion engine idles.

3. The method according to claim 1, wherein in the first method step the statistic evaluation is based on a ratio of engine cycles in which combustion occurs relative to engine cycles in which no combustion occurs.

4. The method according to claim 1, wherein in the first method step the statistic evaluation is based on an engine speed increase for engine cycles in which a combustion occurs.

5. The method according to claim 1, wherein in the first method step the statistic evaluation is based on a number of sequential engine cycles in which a combustion occurs or in which no combustion occurs.

6. The method according to claim 1, wherein in the first method step the statistic evaluation is based on a pattern of engine cycles in which a combustion occurs and of engine cycles in which no combustion occurs.

7. The method according to claim 1, wherein in the first method step the statistic evaluation is based on vibrations generated by the internal combustion engine.

8. The method according to claim 1, wherein in the first method step the statistic evaluation is carried out for a predetermined number of revolutions of the crankshaft.

9. The method according to claim 1, wherein the at least one operating parameter is the supplied fuel quantity.

10. The method according to claim 9, wherein in the second method step the supplied fuel quantity is increased when in the first method step it has been determined that the operating point of the combustion engine is not on the descending branch.

11. The method according to claim 1, wherein the desired operating point in the fourth method step is adjusted by changing the supplied fuel quantity.

12. The method according to claim 1, comprising regularly repeating the statistic evaluation of the first method when the internal combustion engine idles, wherein the second method step, the third method step, and the fourth method step are repeated when the determined operating point is not on the descending branch.

13. The method according to claim 1, wherein the combustion engine is a two-stroke engine, the method comprising supplying fuel and combustion air together through transfer passages into the combustion chamber.

14. The method according to claim 13, comprising supplying the fuel into an intake passage of the internal combustion engine.

15. The method according to claim 13, comprising supplying the fuel directly into the crankcase of the internal combustion engine.

16. The method according to claim 1, comprising, in the second method step, checking after each change of the at least one operating parameter, based on the statistic evaluation, whether the operating point is located on the desired branch.

17. A method for operating an internal combustion engine, wherein the internal combustion engine is a single-cylinder internal combustion engine and comprises a combustion chamber, a piston that delimits the combustion chamber and drives in rotation a crankshaft, a device for supplying fuel, a device for supplying combustion air, and a device for detecting a rotary speed of the crankshaft, wherein the rotary speed is determined in accordance with an operating curve based on a composition of a fuel/air mixture, wherein operating points of the internal combustion engine are lying on the operating curve and the operating curve has an ascending branch, a maximum, and a descending branch, wherein a lambda value in the combustion chamber of the internal combustion engine is smaller than 1 in the range of the descending branch, wherein, for adjusting a desired fuel/air mixture composition, the method comprises:

in a first method step, determining by a statistic evaluation whether an operating point of the internal combustion engine is on the ascending branch or the descending branch by determining in which preceding engine cycles a combustion has occurred in the combustion chamber, wherein, for determining whether a combustion has occurred in an engine cycle, a rotary speed change resulting from the engine cycle is determined;

in a second method step, when the operating point is not positioned on a desired branch of the operating curve that is desired as a starting point for a third method step, changing at least one operating parameter until the operating point is positioned on the desired branch of the operating curve;

in a third method step, determining a position of the maximum of the operating curve due to changing the at least one operating parameter; and in a fourth method step, based on the determined maximum of the operating curve, adjusting the desired operating point of the internal combustion engine.

18. The method according to claim 17, comprising, in the second method step, changing the at least one operating parameter step by step and checking after each change of the at least one operating parameter, based on the statistic evaluation of the first method step, whether the operating point is located on the desired branch.

19. The method according to claim 17, comprising, in the third method step, changing the at least one operating parameter step by step in a direction toward the maximum of the operating curve and determining a resulting rotary speed change, wherein the maximum is present when a change of the at least one operating parameter causes no further increase of the rotary speed and the rotary speed is steady or the rotary speed drops.

20. The method according to claim 17, wherein the statistic evaluation of the first step is based on evaluating a number of engine cycles in which combustion occurs or a number of engine cycles in which no combustion occurs.

21. The method according to claim 20, wherein in the first step the operating point is determined to be on the descending branch when only one engine cycle with combustion occurs that is followed by at least one engine cycle without combustion, respectively.

22. The method according to claim 20, wherein in the first step the operating point is determined to be on the descending branch when a combustion occurs only every six to ten engine cycles.

23. The method according to claim 20, wherein in the first step the operating point is determined to be on the ascending branch when at least two engine cycles with combustion follow each other directly.

24. The method according to claim 17, wherein the statistical evaluation in the first step is based on evaluating a rotary speed increase in engine cycles with combustion, wherein a rotary speed increase when the operating point is on the descending branch is significantly greater than a rotary speed increase when the operating point is on the ascending branch.

25. The method according to claim 17, wherein the desired operating point in the fourth step is on the descending branch and is adjusted by changing a supplied fuel quantity.

* * * * *